US006263509B1

(12) United States Patent
Bowen

(10) Patent No.: US 6,263,509 B1
(45) Date of Patent: Jul. 24, 2001

(54) PROTECTIVE MODULAR GARMENT

(76) Inventor: David R. Bowen, 213 State St., Binghamton, NY (US) 13905

( * ) Notice: Subject to any disclaimer, the term of this patent is extended or adjusted under 35 U.S.C. 154(b) by 0 days.

(21) Appl. No.: 09/528,426

(22) Filed: Mar. 17, 2000

(51) Int. Cl.[7] ..... A41D 3/00
(52) U.S. Cl. ..... 2/69; 2/84; 2/108
(58) Field of Search ..... 2/455, 456, 16, 2/125, 126, 69, 81, 84, 85, 93–94, 115, 44, 338, 410, 129, 6.2, 422, 247, 249

(56) References Cited

U.S. PATENT DOCUMENTS

| | | | | |
|---|---|---|---|---|
| 1,469,626 | | 10/1923 | Dorsey . | |
| 2,540,547 | | 2/1951 | Rodert . | |
| 3,084,241 | | 4/1963 | Carrona . | |
| 4,810,559 | | 3/1989 | Fortier et al. . | |
| 5,182,812 | * | 2/1993 | Goldsby | 2/79 |
| 5,450,627 | * | 9/1995 | Grilliot et al. | 2/81 |
| 5,611,084 | * | 3/1997 | Garry et al. | 2/93 |
| 5,673,836 | * | 10/1997 | Bush | 224/576 |
| 5,717,999 | * | 2/1998 | Lurry | 2/69 |
| 5,718,000 | * | 2/1998 | Ost et al. | 2/69 |
| 5,729,832 | | 3/1998 | Grilliot et al. . | |
| 5,810,699 | * | 9/1998 | Nadeau | 2/102 |
| 5,815,833 | * | 10/1998 | Kuo | 2/69.5 |
| 5,918,314 | * | 7/1999 | Moses | 2/79 |
| 6,009,563 | * | 1/2000 | Swanson et al. | 2/425 |
| 6,029,270 | * | 2/2000 | Ost et al. | 2/2.5 |

* cited by examiner

*Primary Examiner*—John J. Calvert
*Assistant Examiner*—Tejash Patel
(74) *Attorney, Agent, or Firm*—Salzman & Levy

(57) ABSTRACT

A modularly constructed, turf enforcing outfit, consisting of a flack-jacket body portion supporting snap-on extension portions for forearms. In rumbles and other violent confrontations, the forearm and upper arm portions of a garment usually receive the most abuse. The snap-on, interchangeable, forearm portions allow for ease of repair or replacement.

14 Claims, 2 Drawing Sheets

PROTECTIVE MODULAR GARMENT

RELATED APPLICATION

The present invention is related to copending design patent application, Ser. No. 29/103,679, filed Apr. 19, 1999 for "PROTECTIVE CLOTHING."

FIELD OF THE INVENTION

The present invention relates to wearing apparel and, more particularly, to a protective garment having a modularly constructed jacket body having extension portions that can be easily replaced or interchanged.

BACKGROUND OF THE INVENTION

Mankind has been clothing itself since the dawn of history. Primitive man dressed mainly for protection against the harsh elements of nature. Warfare motivated soldiers to use body armor and protective helmets. Socio-economic progress and cultural diversification resulted in clothing designs that were aesthetic as well as useful.

In the twenty-first century, civilized clothing can provide protection not only from environmental factors, but against dangerous neighborhoods, such as gang-infested slums and communities. In urban neighborhoods plagued with random violence and drive-by shootings, protective clothing should provide the appearance of somebody ready to receive and dispense trouble.

The protective garment of the present invention has a rugged and muscular appearance consistent with that of a well dressed, urban, turf enforcer. The suit contains means by which portions of the garment, destroyed in rumbles and other violent episodes, are easily replaced by modular, interchangeable add-ons. The forearms and upper arms of the garment are most likely to require replacement or repair, since these portions generally take the brunt of assaults and attacks.

The outfit comprises a flack-type jacket of heavy canvas. The body-shell of the uniform accommodates snap-on forearm and upper arm extensions. A protective hood or helmet is attachable to a rigid collar mount. Portions of the jacket comprise a sprayed on rubber coating that acts as light, flexible armor against knife, bullet and club forays.

The jacket comprises a built-in back support and belt for positioning the wearer in an upright, defensive position. A self-tensioning belt buckle trims the waist and adjusts the back support. Vest pockets feature storage space for cell phones, batteries, pepper spray, palm pilot, and work light.

A detachable backpack snaps onto the back portion of the jacket, and generally consists of molded plastic. The garment contains internal heating elements that can be powered by a large battery in the backpack. The heating elements can be actuated during winter to provide heat for the body.

DISCUSSION OF RELATED ART

In U.S. Pat. No. 1,469,626, issued to Dorsey on Oct. 2, 1923, for ELECTRIC HEATING SYSTEM, a garment having an insulated heating system is shown.

In U.S. Pat. No. 2,540,547, issued to Robert on Feb. 6, 1951, for AIR CONDITIONED GARMENT, an undergarment is illustrated, which is air cooled in order to provide a comfortable temperature for occupants of aircraft.

In U.S. Pat. No. 3,084,241, issued on Apr. 2, 1963 to Carrona, for ELECTRICALLY HEATED GARMENT, a jacket having electrically actuated heating elements is shown. The garment can be worn by humans or pets.

In U.S. Pat. No. 5,450,627, issued to Grilliot et al, on Sep. 19, 1995, for PROTECTIVE GARMENT CONTAINING LUMBAR SUPPORT MEANS, a garment is illustrated that has an internal lumbar supporting belt.

In U.S. Pat. No. 4,810,559, issued on Mar. 7, 1989, to Fortier et al, for FABRIC WITH WEAR AND ABRASION RESISTANT PLATELETS, a garment is illustrated that has reinforcements in areas most likely to receive wear and abrasion, such as elbows, knees, shoulders, etc. The reinforced sections comprise flexible polymeric thermoplastic or thermosetting materials that are secured to the fabric of the garment by adhesives.

In U.S. Pat. No. 5,729,832, issued on Mar. 24, 1998, to Grilliot et al, for PROTECTIVE GARMENT CONTAINING PUNCTURE-RESISTANT AND/OR FOREARM PORTIONS, a garment is depicted having a number of pockets in which soft pad materials are inserted to provide protection against stab or puncture wounds.

In U.S. Pat. No. 5,673,836, issued to Bush, on Oct. 7, 1997, for MODULAR COMPARTMENTALIZED OUTDOOR APPAREL, a backpack and garment is illustrated, wherein various pockets are provided for carrying gear, food, equipment, ammunition, etc. The garment and backpack are reconfigurable, so that items can be rearranged about the garment and backpack for convenience and ready access.

SUMMARY OF THE INVENTION

In accordance with the present invention, there is provided a protective garment having storage pockets. The garment is of a modular design, wherein extension portions can be added or detached via plug members that snap into, or out of, nylon receptacles disposed upon the garment body.

The protective garment has a rugged and muscular appearance consistent with that of a well dressed turf enforcer. The extension portions of the garment destroyed in rumbles and other violent episodes are easily interchangeable, allowing for quick repair. The garment comprises a flack-type jacket consisting of heavy canvas. The body-shell of the jacket accommodates snap-on forearm and upper arm extensions. A protective hood or helmet is attachable to a rigid collar mount. The helmet comprises a see-through visor of Lexan. Portions of the jacket comprise a rubber coating that acts as light armor against knife, bullet and club forays. The jacket comprises a built-in back support and belt for positioning the wearer in an upright, defensive position. A self-tensioning belt buckle trims the waist and adjusts the back support. Vest pockets feature storage space for cell phones, batteries, pepper spray, palm pilot, and work light. A detachable backpack snaps onto the back portion of the jacket, and generally consists of molded plastic. The garment contains internal heating elements that can be powered by a large battery in the backpack. The heating elements can be actuated during winter to provide heat to the wearer.

It is an object of this invention to provide a protective garment for an urban, turf enforcing individual.

It is another object of the invention to provide an improved turf enforcing uniform that comprises modular, interchangeable extension portions.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components will bear the same designation and numbering throughout the figures.

DESCRIPTION OF THE PREFERRED EMBODIMENT

Generally speaking, the invention features a turf enforcing outfit comprising a flack-jacket body portion supporting snap-on extension portions for forearms and upper arms. In rumbles and other violent confrontations, the forearm and upper arm portions of a garment usually receive the most abuse. Therefore, the snap-on forearms and shoulder portions allow for ease of repair or replacement.

Figure 1A:
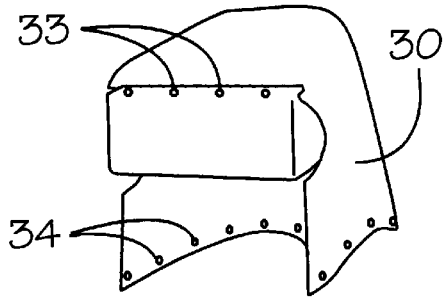
FIG. 1*a* is a perspective, front view of the helmet portion of the garment shown in FIG. 1.
Figure 1:
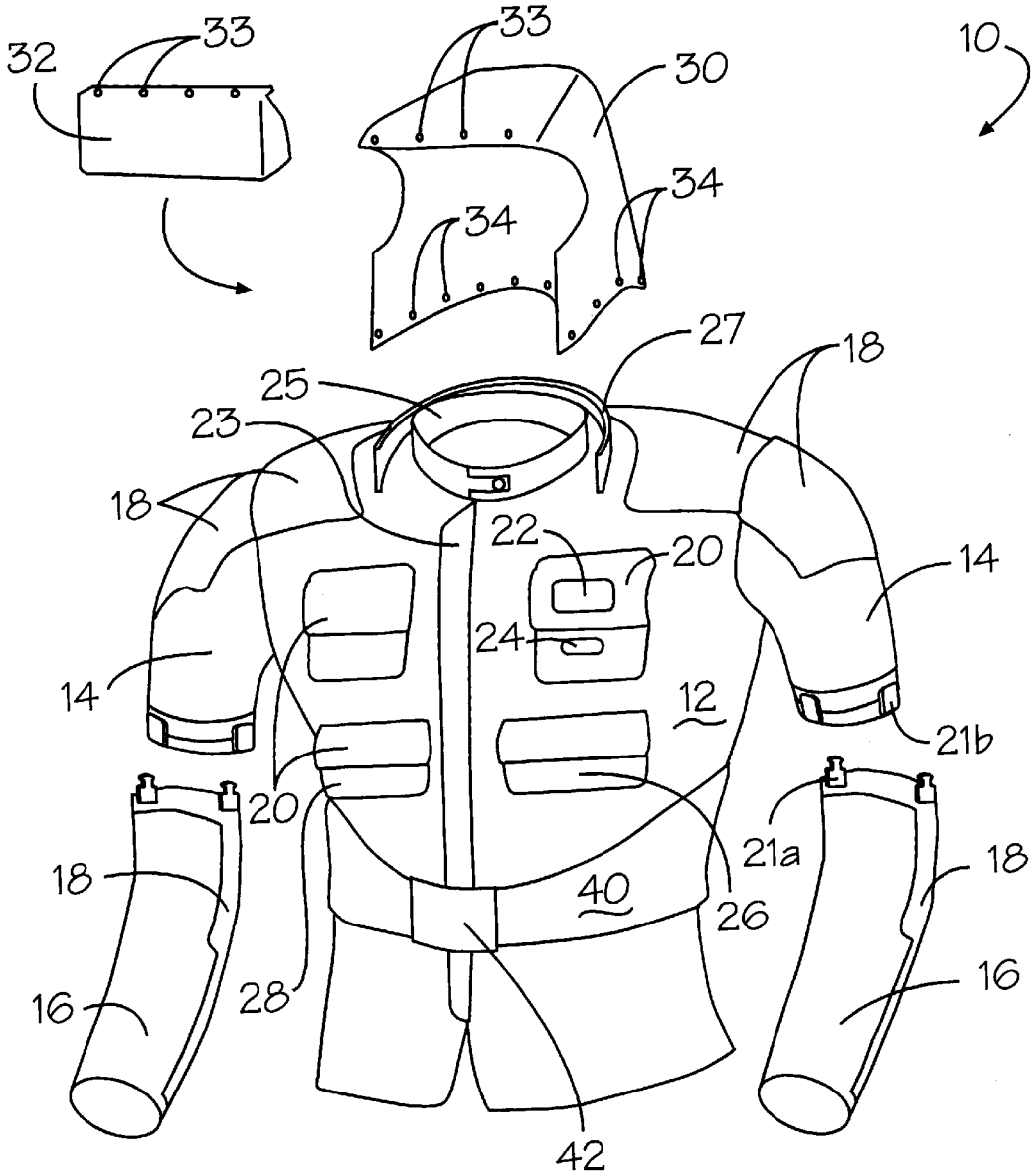
FIG. 1 is a perspective, expanded, front view of the protective garment of this invention.

Now referring to FIG. 1, a turf enforcing garment 10 of this invention is illustrated. The garment 10 comprises a flack-jacket body portion 12, to which upper arm and forearm extension portions 14 and 16, respectively, are attached. The extension portions 14 and 16 are attachable by means of "male/female" plugs and receptacles, 21*a* and 21*b*, respectively, which are nylon in the preferred embodiment. The plugs and receptacles snap together for quick fit and release.

The body portion 12 comprises heavy duty denim or heavy weight cotton canvas material. A flexible rubber, abrasive-resistant coating 18 is sprayed onto the body and extension portions mostly likely to receive wear, abuse, and attack from weapons encountered in rumbles and other violent acts.

A zipper flap 23 is secured by Velcro to protect a heavy-duty zipper (not shown). A canvas collar 25 is supported upon a top section of the jacket body 12. A rigid mounting collar 27 of rubber coated styrene is disposed peripherally about the inner collar 25.

The front of the jacket body portion 12 comprises a number of typical storage pockets 20, common to flack-type jackets of this genre. A detachable work light 22 is disposed on the front right pocket 20. The work light 22 is actuated by a switch 24 disposed in the lower half of the pocket 20, as shown. The storage pocket disposed below the light-containing pocket 20 carries a rechargeable battery, not shown, for powering the light 22. A cell phone 28 is carried in the lower, lefthand pocket 20. Other pockets can be used for palm pilots, keys, pepper spray, handcuffs, etc.

Referring also to FIG. 1*a*, a helmet or hood covering 30 is illustrated. The helmet 30 comprises clear Lexan, and has a snap-on safety shield 32. The helmet 30 attaches to the rigid mounting collar 27 by means of a plurality of snap attachments 34. The Lexan safety shield 32 attaches to the helmet 30 via attachment snaps 33.

Figure 2:
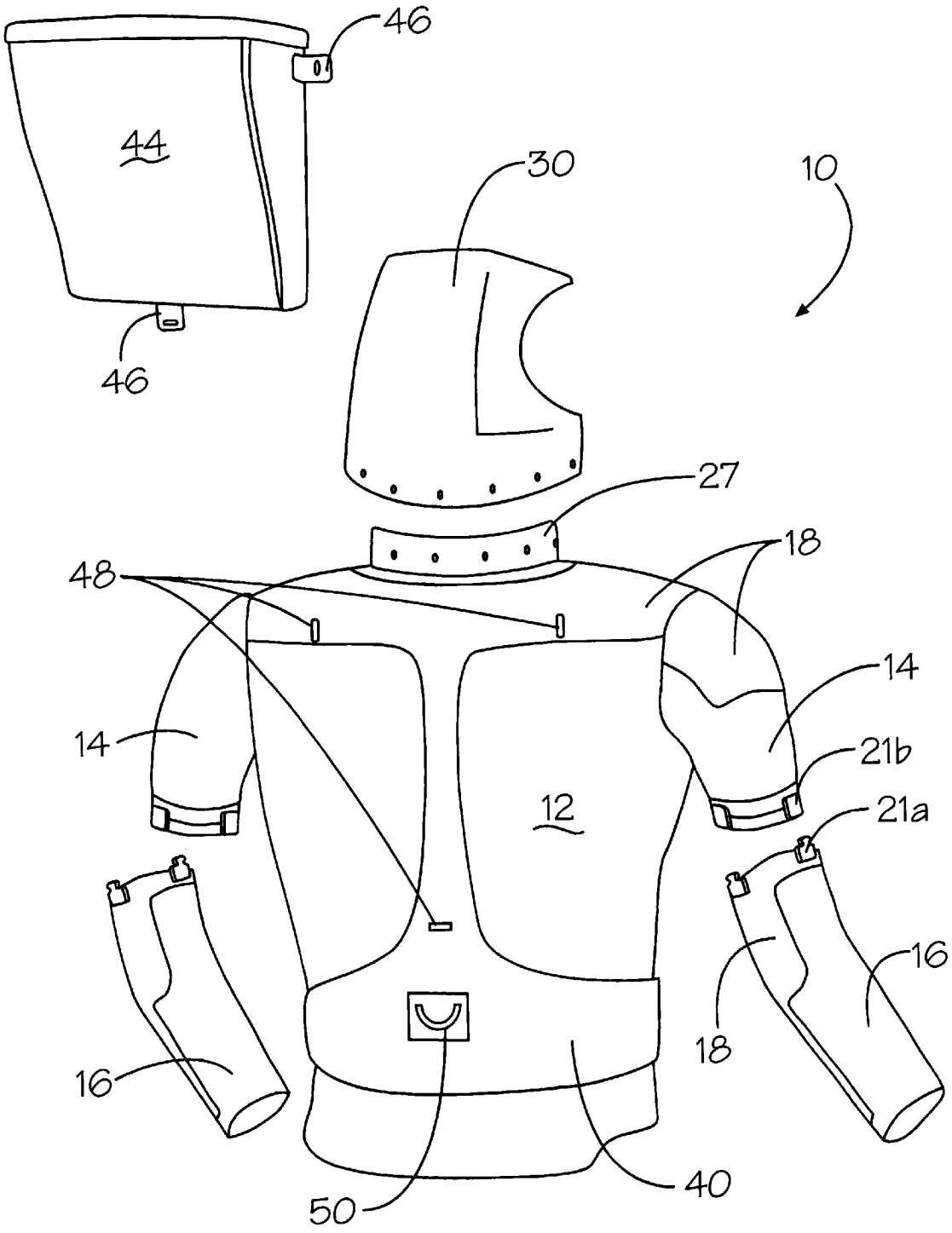
FIG. 2 is a perspective, expanded, back view of the protective garment illustrated in FIG. 1.

Referring to FIGS. 1 and 2, the body portion 12 is girdled by a back support belt 40. The belt 40 is adjustable by means of a self-tensioning belt buckle 42.

An easily attachable/detachable modular backpack 44 comprising molded plastic, having three straps 46, is attachable to respective attachment clips 48. The backpack 44 can contain a large, rechargeable battery, not shown, for heating the jacket body 12, via internal resistive heating elements, not shown. A ring 50 for connecting the jacket body 12 to a safety line, not shown, is disposed at the center, rear of the jacket body 12.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A modular, protective jacket, comprising:

a jacket body portion having protective sections comprising a flexible, abrasive-resistant coating;

a pair of upper arm extensions attached to said jacket body portion;

a back supporting belt that girds said jacket body portion having a tensioning belt buckle for adjusting said back supporting belt about said jacket body portion;

a self-tensioning belt buckle;

modular forearm extensions that are attachable to said jacket body portion via said upper arm extensions, said modular forearm extensions being interchangeable; and a plurality of storage pockets disposed on a front section of said jacket body portion.

2. The modular, protective jacket in accordance with claim 1, wherein said forearm extensions are at least partially covered with a flexible, abrasion resistant coating.

3. The modular, protective jacket in accordance with claim 1, wherein said upper arm extensions are at least partially covered with a flexible, abrasion resistant coating.

4. The modular, protective jacket in accordance with claim 1, further comprising a backpack that modularly attaches to said jacket body portion.

5. The modular, protective jacket in accordance with claim 1, wherein said jacket body portion comprises a collar, and further comprising a helmet for attachment to said collar.

6. The modular, protective jacket in accordance with claim 5, wherein said helmet has a plurality of snaps for attachment to said collar.

7. The modular, protective jacket in accordance with claim 5, wherein said helmet includes a safety shield supported thereupon.

8. A modular, protective, turf enforcing jacket, comprising:

a fabric jacket body portion having protective sections comprising a flexible, abrasive-resistant coating;

a pair of upper arm extensions attached to said jacket body portion;

modular forearm extensions that are attachable to said jacket body portion via said upper arm extensions, said modular forearm extensions being interchangeable;

a back supporting belt that girds said jacket body portion having a tensioning belt buckle for adjusting said back supporting belt about said jacket body portion;

a plurality of storage pockets disposed upon said jacket body portion; and a protective collar disposed upon an upper portion of said jacket body.

9. The modular, protective, turf enforcing jacket in accordance with claim 8, wherein said forearm extensions are at least partially covered with a flexible, abrasion resistant coating.

10. The modular, protective, turf enforcing jacket in accordance with claim 8, wherein said upper arm extensions are at least partially covered with a flexible, abrasion resistant coating.

11. The modular, protective, turf enforcing jacket in accordance with claim 8, further comprising a backpack that modularly attaches to said jacket body portion.

12. The modular, protective, turf enforcing jacket in accordance with claim 8, wherein said protective collar is rigidly disposed upon said jacket body portion, and further comprising a helmet for attachment to said rigidly disposed collar.

13. The modular, protective, turf enforcing jacket in accordance with claim 12, wherein said helmet has a plurality of snaps for attachment to said rigidly disposed collar.

14. The modular, protective, turf enforcing jacket in accordance with claim 12, wherein said helmet includes a safety shield supported thereupon.

* * * * *